US005368168A

United States Patent [19]

Marrs et al.

[11] Patent Number: 5,368,168

[45] Date of Patent: Nov. 29, 1994

[54] BAR SCREEN WITH BARS OF STAGGERED HEIGHT

[75] Inventors: Gevan R. Marrs, Puyallup; Gail E. Johnson, Auburn, both of Wash.

[73] Assignee: Weyerhaeuser Co., Tacoma, Wash.

[21] Appl. No.: 53,906

[22] Filed: Apr. 26, 1993

[51] Int. Cl.[5] ..... B07B 1/49

[52] U.S. Cl. ..... 209/396; 209/674

[58] Field of Search ..... 209/393, 394, 395, 396, 209/660, 674

[56] References Cited

U.S. PATENT DOCUMENTS

| | | | |
|---|---|---|---|
| 1,109,302 | 9/1914 | Rice | 209/396 X |
| 4,935,124 | 6/1990 | Daugherty et al. | 209/393 X |
| 5,117,983 | 6/1992 | Marrs | 209/393 X |
| 5,191,904 | 3/1993 | Arents et al. | 209/393 X |

FOREIGN PATENT DOCUMENTS

| | | | |
|---|---|---|---|
| 0062792 | 6/1892 | Germany | 209/396 |

*Primary Examiner*—D. Glenn Dayoan
*Assistant Examiner*—Tuan N. Nguyen
*Attorney, Agent, or Firm*—Jensen & Puntigam

[57] ABSTRACT

A bar screen system comprising two sets of interleaved bars. In each set, the height of the individual bars is staggered so that every third bar is higher than the other bars, which are the same height. The bars are driven such that the bars in one set are approximately 180° behind the other set in their respective predetermined paths of movement, resulting in a tipping and agitation action which tends to present the wood chips loaded at a high rate onto the bar screen in their thickness dimension to the slots between adjacent bars.

7 Claims, 4 Drawing Sheets

BAR SCREEN WITH BARS OF STAGGERED HEIGHT

TECHNICAL FIELD

This invention relates generally to the field of bar screen apparatus for sorting wood chips and more specifically concerns a particular bar arrangement for such a bar screen apparatus.

BACKGROUND OF THE INVENTION

One of the primary general performance goals for a bar screen apparatus is to combine a high capacity for receiving and sorting wood chips with a low accepts carryover rate, i.e., a low rate of chips of acceptable size for the particular bar screen proceeding off the outfeed end of the bar screen. This goal is applicable for all bar screen apparatus, regardless of the particular configuration and/or arrangement of the bar screen itself. For bar screens which are designed to process the wood chips in a thickness dimension, a chip loading rate in the range 0.30–0.50 units per hour per square foot of screen surface (UPHPSF) is typical. Within this loading range, with an overthick removal efficiency (ORE) of about 85% or greater, an accepts carryover rate (ACR) in the range of 5–20% is normally acceptable.

A bar screen which significantly exceeds the above performance would be very competitive in the industry, while a bar screen which performed below such a standard would be at a competitive disadvantage and likely would not be well accepted in the industry.

Various attempts have been made to improve bar screen performance by varying one or more of the following parameters: the direction and/or amount of inclination of the bars, the speed of the bars, and the configuration of the bars. These attempts, directed generally toward maximizing capacity while minimizing accepts carryover, while maintaining overthick removal at an acceptable level, have met with varying success.

One recent example is shown in U.S. patent application Ser. No. 07/918,645, in the name of Gevan R. Marrs and assigned to the same assignee as the present invention. That application is directed toward a particular kind of bar screen using thin, blade-like bar elements on the order of 1/16 inch thick, instead of the relatively thick, rigid (approximately ½ inch thick) bars used in conventional bar screen systems. This "blade screen" arrangement, in which the bars are held in tension at opposing ends, has significant performance promise because the percentage of open area of the screen is quite high, within the range of 50–90%, compared to a much lower percentage of open area, usually around 35%, for bar screens using conventional bars. However, adequate loading capacities have been difficult to achieve with the blade screen arrangement.

In addition, bar screens using more conventional bars, with lower percentage of open area figures, would also benefit significantly in performance if loading capacity could be increased without affecting the accepts carryover rate.

Accordingly, it is desirable to increase the capacity of bar screens while maintaining a high overthick removal and an accepts carryover rate within an acceptable range, in order to improve overall performance. This is particularly desirable for bar screens using relatively thin bars; i.e. those bar screens having a large percentage of open area, which appear to possess a structure capable of achieving relative high loading capacity.

SUMMARY OF THE INVENTION

Accordingly, the present invention is a wood chip screening system which includes a first screen assembly which is under a first set of screening bars, wherein every third bar is taller than the other bars in said first set; a second screen assembly which includes a second set of screening bars, wherein every third bar is taller than the other bars in the second set and wherein the first and second screen assemblies are arranged such that the bars in the first set are interleaved with the bars in the second set; and means for driving the bars in the first and second sets thereof in such a manner that they move both longitudinally and vertically in a predetermined path, resulting in chips being tipped up by the action of the bars so that the thickness dimension thereof tends to be presented to openings between the bars.

DESCRIPTION OF THE PREFERRED EMBODIMENT

Figure 1:
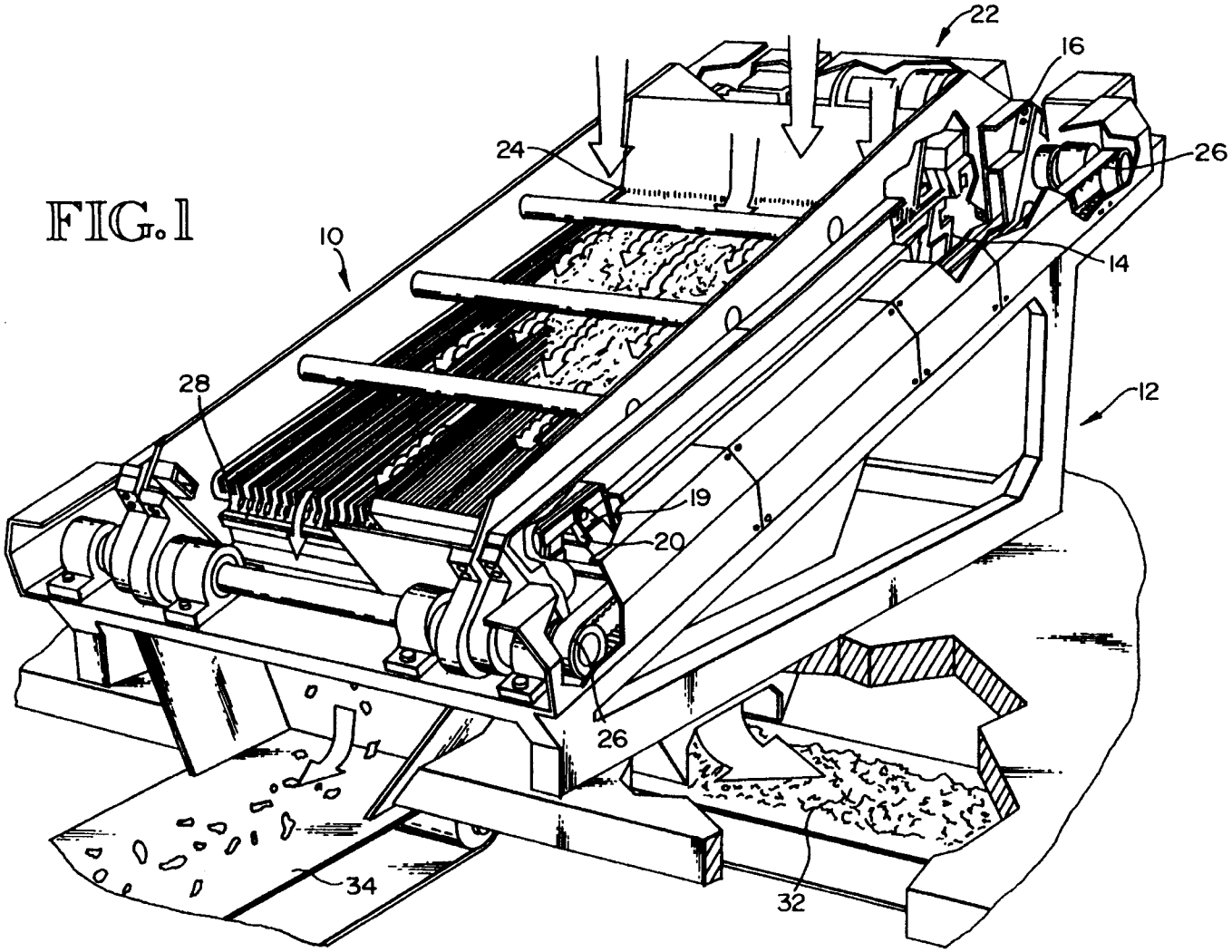
FIG. 1 is a perspective view of a bar screen apparatus in a commercial environment.

FIG. 1 shows a typical bar screen apparatus for sorting wood chips. The bar screen apparatus, referred to generally at 10, is positioned on a base support assembly 12 which in FIG. 1 supports the bar screen apparatus 10 at a downward incline from infeed end to outfeed end thereof. The bar screen apparatus could be positioned at various angles, either inclining downwardly or upwardly in the direction of the outfeed end, or it could be flat.

In a typical embodiment, the bar screen itself will be approximately ten feet long, with a selected width. In commercial embodiments, the widths typically will be 6½, 8½ or 10 feet. The bar screen apparatus will typically include two sets of interleaved bars, with each set being driven separately but such that the bars in one set have a selected spatial relationship with the bars in the other set. An example of such a bar screen with two sets of interleaved bars is shown in U.S. Pat. No. 5,117,983 to Marrs, assigned to the same assignee as the present invention, the contents of which are hereby incorporated by reference.

In the particular embodiment shown in FIG. 1, one set of bars is supported at the respective ends thereof by end support assemblies 14 and 16, while the other set of bars is supported by end support assemblies 19 and 20. The end support assemblies shown in FIG. 1 are adapted specifically to maintain each individual bar under tension. Such a system is necessary, for instance, where the bar elements are relatively thin and would otherwise twist or bend significantly in operation. Such a tension type bar screen and its supporting elements are shown in more detail in U.S. patent application Ser. No. 918,645 to Marrs, assigned to the same assignee as the present invention, the contents of which are hereby incorporated by reference.

The two sets of interleaved bars in the apparatus of FIG. 1 are driven by a drive mechanism 22, which is positioned near the infeed end 24 of the bar screen apparatus. The drive mechanism 22 operates from a motor via gears, drive shaft and eccentrics to flange elements which connect to the support frames in which the respective two sets of bars are mounted. The driving action is also transmitted to the outfeed end of the support frames by means of a belt assembly and pulley arrangement shown generally at 26.

In operation, the two sets of interleaved bars are operated at a relatively high speed, within the range of 200–350 RPM, with the movement of one set of bars being approximately 180° behind the bars in the other set. This is explained in more detail in the '983 patent. Wood chips from a loaded hopper or other container (not shown) are loaded onto bar screen 10 at infeed end 24, shown diagrammatically in FIG. 1. The wood chips are bounced around by the action of the interleaved bar screens, with the individual chips being tipped up so that their thickness dimension is presented to the openings between the bars.

Those chips having a thickness dimension less than the opening size between adjacent bars will fall through the bar screen to a conveyor 32 which moves those acceptable size chips to a predetermined location for storage or processing into pulp or other use. Those chips which have a thickness dimension larger than the bar screen openings or which for some reason were not tipped properly so as to present their thickness dimension to the openings eventually move off the outfeed end 28 of the bar screen to another conveyor 34 which moves those chips to another station for further size processing, such as to an apparatus known as a chip slicer, or similar device, which reduces the size of the chips. The chips from the chip slicer are then typically added directly to the acceptable chip flow but could be returned to the screen. The above process continues as long as chips are loaded onto the screen.

As indicated above, loading capacity is a significant issue in bar screen operation. Those bar screens which have a fairly large percentage of open area present what would appear to be an inherent capability for a large loading capacity. The present invention is designed to significantly improve bar screen loading capacity, particularly for those bar screens which use relatively thin (blade-like) bars. The invention includes two sets of interleaved blades, similar to a conventional bar screen. In the present arrangement, however, selected ones of the blades/bars in each set are higher than the remainder of the blades, i.e. the blades present a "staggered" appearance over at least a portion, if not all, of their length.

Figure 2:
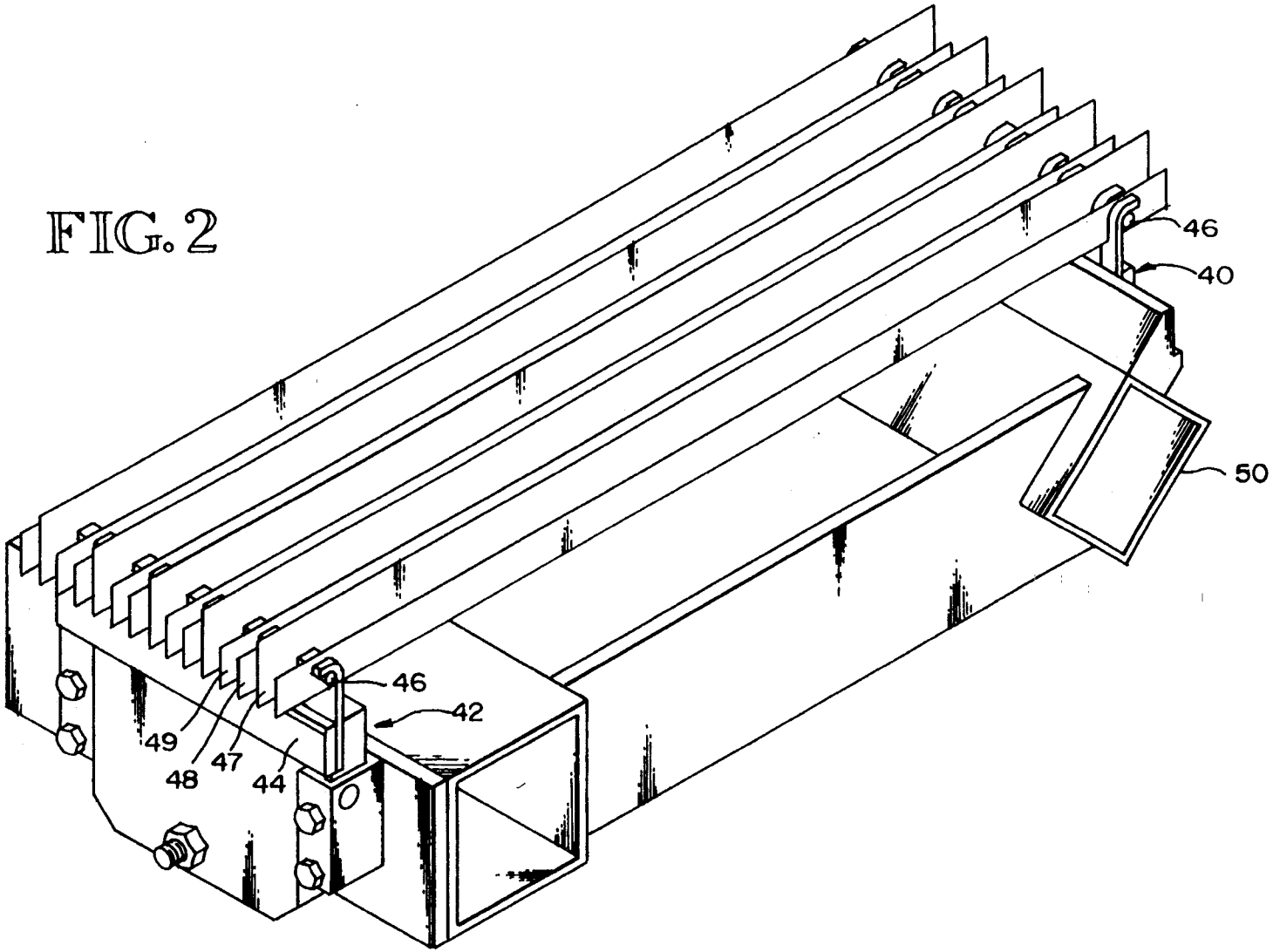
FIG. 2 is a perspective view of a portion of the bar screen of the present invention, showing a particular bar arrangement.

This is illustrated in FIG. 2, which shows a portion of one set of blades in a bar screen. The individual blades are held by end support assemblies 40 and 42, which each include a slotted support element 44, which holds the individual blades in a spaced side-by-side relationship. The individual blades are secured to the slotted support element 44 by various retaining elements such as by pins 46 which pass through holes in the blades.

The end support assemblies 40, 42 are connected to a base assembly 50, which in turn is driven by a conventional bar screen drive means (not shown). While the particular bar support arrangement of FIG. 2 is shown for illustration, it should be understood that various bar support mechanisms may be conveniently used. In the particular arrangement of FIG. 2, every third blade 47 is taller than the intervening two blades 48, 49, which are the same height. In the particular embodiment shown, the taller blades are approximately 2½ inches high and 0.063 inches thick, while the shorter blades are approximately 1½ inches high and also 0.063 inches thick. The difference in height between the taller and shorter blades is thus approximately one inch.

The spacing between adjacent interleaved blades in a complete two set arrangement is approximately 0.315 inches. The pattern of the interleaved blades is as follows: a tall blade from one set (typically the blades at the longitudinal edges of the bar screen will both be tall), followed by a short blade from the other set, a short blade from the one set, a tall blade from the other set, a short blade from the one set and a short blade from the other set. This pattern repeats itself across the width of the bar screen. For a bar screen width of 8.5 feet, there are 150 blades in each set in the embodiment shown, although this of course may be varied. In the present embodiment, the bar screens are driven so that they move through a horizontal and vertical distance of approximately one inch. This too may be varied.

Figure 3:
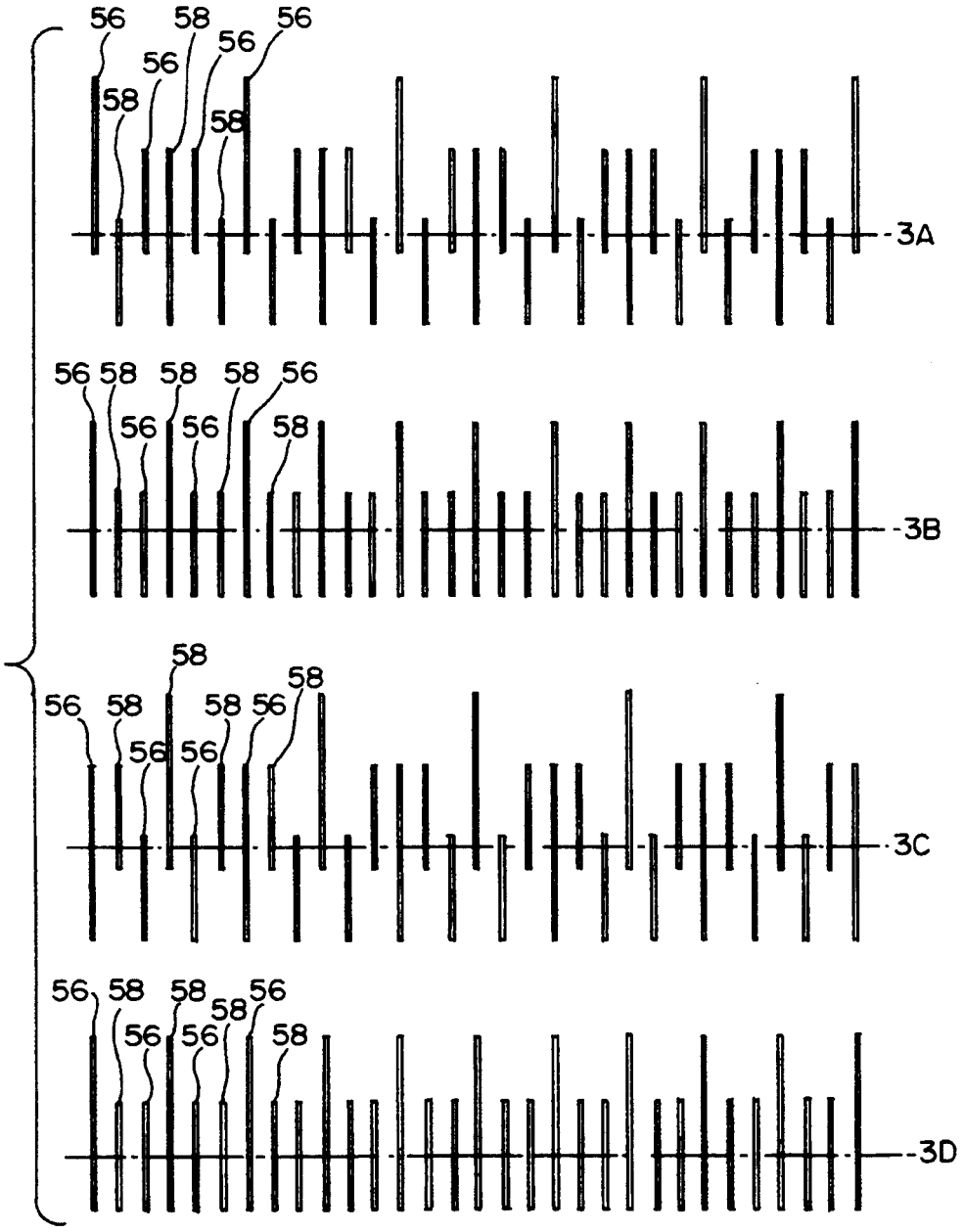
Figure 3(a–d) is diagram showing the relative position of the bars in the bar arrangement of the present invention at four spaced angular positions.

The position of the blades in the screen arrangement described above at four operating positions is shown in Figures 3(a–d). In Figures 3(b) and 3(d) the two sets of blades are at a midpoint in their travel, approximately 180° apart. In Figure 3(b) one set of blades, represented by the numeral 56, is moving from a low point in its cycle to a high point while the other set of blades 58 is moving from a high point to a low point; in Figure 3(d), the position of the two sets of blades is the same as in Figure 3(b) but they are moving in the opposite direction. In Figure 3(b), the tall blades from both sets of blades are in the same vertical position and the short bars from both sets are in the same vertical position. The bottoms of all the blades are co-planar and the tops of the tall blades are co-planar and one inch higher than the co-planar tops of the short blades.

FIG. 3 shows the position of the blades when the blades in one set are all in their highest vertical position, while the blades from the other set are all in their lowest vertical position. In this position, the tops of the short blades in the one set are co-planar with the tops of the tall blades in the other set, while the tops of the tall blades in the one set are one inch thereabove. FIG. 3 shows the opposite (180° removed) position, in which the blades in the other set are all in their highest position while the blades in the one set are in their lower position. In this position, the tops of the short blades in the other set are co-planar with the tops of the tall blades in the one set, while the tops of the tall blades in the other set are all one inch above those particular blades.

The arrangement of FIGS. 3 is quite effective in introducing a significant tipping action to the chips. This is because there exists a significant vertical displacement between the tops of the uppermost blades and the tops of adjacent blades throughout a substantial portion of the cycle of movement of the blades, while at the same time, there are significant clear lateral spaces between successive tall blades. Thus, chips tend to be tipped up by the action of the tall blades and fall into the spaces therebetween in the thickness dimension.

The arrangement where every third blade of both sets is tall has proved to be quite effective in producing a reliable tipping action, resulting in a loading capacity which is unexpectedly high, while the accepts carryover remain acceptably low. Load rates of 0.9, 1.0 and even as high as 1.2 UPHPSF (units per hour per square foot of screen surface) have been achieved. This performance is significantly greater than could be expected and also is significantly greater than any other bar screen apparatus. With tall bars/blades positioned either more frequently in the set, i.e. every other blade, or less frequently, i.e. every fourth blade or greater, results rather dramatically decrease. It is possible to have only one set with every third blade being tall, with the other set having blades of one height, and achieve improved screen performance, but the use of tall blades for every third blade for both sets produces the dramatically improved results described above.

Further, it appears that the height differential, i.e. one inch, between the tall and short bars is important to achieve the desired tipping action. A much reduced height differential, i.e. more than a quarter inch or so, will not produce the dramatically improved results discussed above, and the same is true for an increased height differential. An approximate range of acceptable height differential is $\frac{3}{4}$–$1\frac{1}{4}$ inches.

Figure 4:
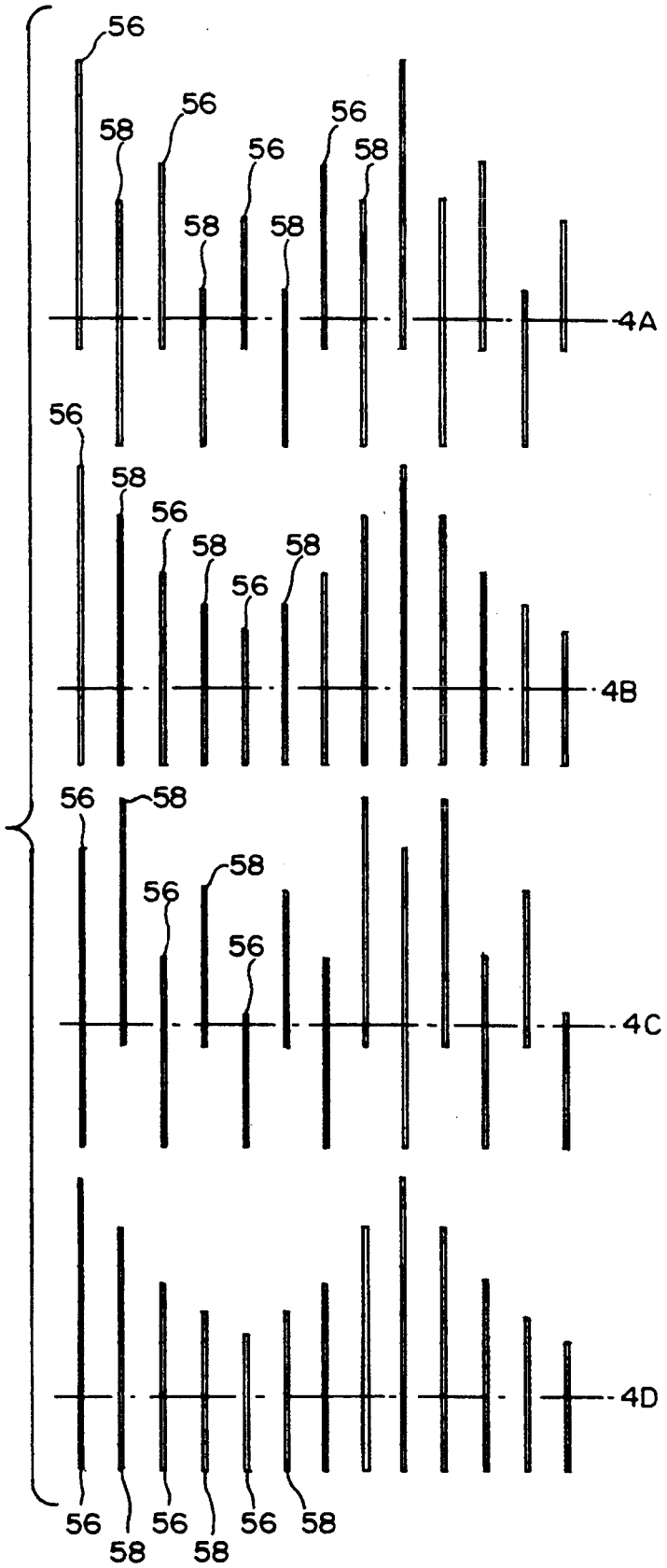
Figure 4(a–d) is diagram similar to that of Figure 3(a–d) showing another bar arrangement.

Figures 4(a–d) show a somewhat different bar/blade pattern which is more complex than that of Figures 3(a) and 3(d), but has some similarities thereto. The pattern of 4(a–d) is based on a repeating sequence of four blades in each set. The tallest blade in one set 56 is $2\frac{1}{2}$ inches, the next tallest blade is $1\frac{3}{4}$ inches, the next tallest blade is one inch, and the next blade is again $1\frac{1}{2}$ inches. The pattern for the other set 58 is also based on a sequence of four blades, with the tallest blade being two inches, the next two blades $1\frac{1}{4}$ inches, and the final blade again two inches. This produces the interesting result, at the two midpoints in the cycle (Figures 4(b), 4(d) of a wave-like pattern. The two extreme positions, both of which have different patterns, due to the different patterns of each individual set, are shown in Figures 4(a) and 4(c). The pattern of Figures 4(a–4), however, while having some visual appeal, may likely be too complex and may likely not produce the exceptional results of Figure 3(a–d).

While the use of staggered height bars in a bar screen arrangement in a very broad sense are known, it appears that the arrangement where the staggered bar height is based on a three bar sequence, particularly in both sets, is significant in achieving unexpectedly good results relative to load capacity, while maintaining an acceptable carryover rate.

Although a preferred embodiment has been disclosed for purpose of illustration, it should be understood that various changes, modifications and substitutions may be made without departing from the spirit of the invention which is defined by the claims which follow:

We claim:

1. A wood chip screening system, comprising:

a first screen assembly, which includes a first set of screening bars, wherein the first set of screening bars includes a repetitive pattern of bars in which a same one of every three successive bars in the first set is taller than the other bars in said first set and wherein said other bars in said first set are of equal height;

a second screen assembly which includes a second set of screening bars, wherein the second set of screening bars includes a repetitive pattern of bars in which a same one of every three successive bars in said second set is taller than the other bars in the second set, wherein said other bars in said second set are of equal height and wherein the first and second screen assemblies are arranged such that the bars in the first set are interleaved with the bars in the second set, such that one bar of every three successive bars is taller than the other bars; and means for driving the bars in the first and second sets thereof in such a manner that they move both longitudinally and vertically in a predetermined path, resulting in chips being tipped up by the action of the bars so that the thickness dimension thereof tends to be presented to openings between the bars.

2. A system of claim 1, wherein the screening system has a length and a width, and wherein the bars from the first and second sets are interleaved in such a manner that the spacing between adjacent bars is approximately the same across the width of the screening system.

3. A system of claim 1, wherein the tall bars in the one set are the same height as the tall bars in the other set and the other bars in the one set are the same height as the other bars in the other set.

4. A system of claim 3, wherein the bars in the one set are 180° angularly removed from the bars in the other set in their respective predetermined paths.

5. A system of claim 4, wherein the tall bars in the first and second sets are approximately 1 inch higher than the other bars in the first and second sets.

6. A system of claim 4, wherein the percentage of open area of the bar screen is within the range of 50–90%.

7. A system of claim 1 wherein the bars are thin blade elements, held under tension at opposing ends thereof.

* * * * *